US007215222B2

(12) United States Patent
Baird et al.

(10) Patent No.: US 7,215,222 B2
(45) Date of Patent: May 8, 2007

(54) DUAL POLARIZATION WAVEGUIDE PROBE SYSTEM WITH WEDGE SHAPE POLARIZATION ROTATOR

(75) Inventors: Andrew Patrick Baird, Hampshire (GB); Jamie Stokes, Berkshire (GB)

(73) Assignee: Channel Master Limited, Theale, Berkshire (GB)

( * ) Notice: Subject to any disclaimer, the term of this patent is extended or adjusted under 35 U.S.C. 154(b) by 0 days.

(21) Appl. No.: 11/061,582

(22) Filed: Feb. 18, 2005

(65) Prior Publication Data

US 2005/0140461 A1 Jun. 30, 2005

Related U.S. Application Data

(63) Continuation of application No. 10/684,325, filed on Oct. 10, 2003, now abandoned, which is a continuation of application No. 09/980,724, filed as application No. PCT/GB00/01855 on May 17, 2000, now abandoned.

(30) Foreign Application Priority Data

May 17, 1999 (GB) ..... 9911449.8

(51) Int. Cl.
*H01P 1/161* (2006.01)
*H01P 1/165* (2006.01)

(52) U.S. Cl. ..... 333/137; 333/21 A

(58) Field of Classification Search ..... 333/21 A, 333/137
See application file for complete search history.

(56) References Cited

U.S. PATENT DOCUMENTS 6,018,276 A * 1/2000 Hirota et al. ..... 333/26

FOREIGN PATENT DOCUMENTS

WO WO 96/28857 * 9/1996

* cited by examiner

*Primary Examiner*—Benny Lee
(74) *Attorney, Agent, or Firm*—Darby & Darby

(57) ABSTRACT

There is disclosed herein a waveguide rotator for use with a dual polarization waveguide probe system. The waveguide has an internal structure that protrudes into the waveguide such that a first orthogonal component of the incident polarized signal propagates to the end of the waveguide and is reflected therefrom and the second orthogonally polarized component is cut-off by the protruding structure which narrows the waveguide, at a distance from a short circuit at the end of the waveguide, and is reflected substantially at the cut-off point, the cut-off point being frequency dependant. At some predetermined distance from the reflecting means and the cut-off point, the first component and the second component are recombined such that the polarization of the recombined structure is rotated 90° from the incident polarization. The protruding interior surface creates a pocket or cavity behind the waveguide into which components from a circuit board can be inserted.

10 Claims, 11 Drawing Sheets

DUAL POLARIZATION WAVEGUIDE PROBE SYSTEM WITH WEDGE SHAPE POLARIZATION ROTATOR

CROSS-REFERENCES TO RELATED APPLICATIONS

This application is a continuation of application Ser. No. 10/684,325, filed on Oct. 10, 2003, now abandoned which is a continuation of application Ser. No. 09/980,724, filed on May 29, 2002, now abandoned, filed as 371 of international application No. PCT/GB00/01855, filed on May 17, 2000.

FIELD OF THE INVENTION

The present invention relates to a system and to an apparatus and method for rotating a polarised signal in a waveguide. The present invention is particularly, but a not exclusively, suited for use with a dual polarisation waveguide probe system in a low-noise block (LNB) for use with a satellite dish receiving signals broadcast by a satellite which includes two signals orthogonally polarised in the same frequency band.

BACKGROUND

In applicant's co-pending published International Application WO 92/22938 there is disclosed a dual polarisation waveguide probe system in which a waveguide is incorporated into a low-noise block receiver in which two probes are located for receiving linearly polarised energy of both orthogonal senses. The probes are is located in the same longitudinal plane and on opposite sides of a single cylindrical bar reflector which reflects one sense of polarisation and passes the orthogonal signal with minimal insertion lose and then reflects the rotated orthogonal signal. The probes are spaced $\lambda/4$ from the reflector. A reflection rotator is also formed at one end of the waveguide using a thin plate which is oriented at 45° to the incident linear polarisation with a short circuit spaced approximately a quarter of a wavelength ($\lambda/4$) behind the leading edge of the plate. This plate splits the incident energy into equal components in orthogonal planes, one component being reflected by the leading edge and the other component being reflected by the waveguide short circuit. The resultant 180° phase shift between the reflected components causes a 90° rotation in the plane of linear polarisation upon recombination so that the waveguide output signals are located in the same longitudinal plane. Furthermore, in applicant's: co-pending International Patent Application PCT/GB96/00332, an improved dual polarisation waveguide probe system is disclosed for use with a wider frequency range transmitted by new satellite systems. In this improved probe system, a reflective twist plate was provided within the probe housing, the reflective twist plate having at least two signal reflecting-edges so that at least two separate signals reflections are created. The multiple signal reflections enable the probe system to operate over a wider frequency range with minimal deterioration and signal output.

Applicant's co-pending International Published Application PCT/GB97/02428 disclosed a further improved waveguide which is able to operate across the entire frequency band of a satellite system with substantially the same performance. In this system the waveguide included a rotator which incorporated a reflecting plate in combination with a differential phase shift portion in the form of a waveguide of slightly asymmetrical cross-section so that orthogonally polarised signals that travel through the portion have different cut-off wavelengths. This results in a signal rotator which achieves 180° phase shift between two orthogonal components across the frequency range of signals received by the waveguide. The reflecting plate and the differential phase portion have inverse phase change with frequency characteristics so that the combined phase shift characteristic of the rotator shows a flatter response across the desired frequency range.

Although these systems generally work well, they suffer from a number of disadvantages. First, a waveguide which incorporates an edge reflecting plate can incur inconsistencies over a large number of repeated castings and as the leading edge of the plate becomes thinner, it is more likely that the reflecting edge will be damaged in casting and the materials which can be suitably cast to provide such leading edges becomes limited. Furthermore, these systems are generally used with circular waveguides and it is desirable to provide an improved waveguide rotation system which can be used with other waveguide shapes such as square or rectangular which still provides suitable rotation performance. Furthermore, with such existing waveguides the overall dimensions of the waveguide housing are often determined by the waveguide. Furthermore, the use of solely circular waveguides can limit the design options for the circuit board housing and a smaller housing can be afforded by the use of a square waveguide.

OBJECTS OF THE INVENTION

An object of the present invention is to provide an improved waveguide structure and waveguide which obviates or mitigates at least one of the aforementioned disadvantages.

This is achieved by providing a waveguide with an internal structure which protrudes into the waveguide such that a first orthogonal component of the incident polarised signal propagates to the end of the waveguide and is reflected therefrom and the second orthogonally polarised component is cut-off by the protruding structure which narrows the waveguide, at a distance from a short circuit at the end of the waveguide, and is reflected substantially at the cut-off point, the cut-off point being frequency dependent. At some predetermined distance from the reflecting means and the cut-off point, the first component and the second component are recombined such that the polarisation of the recombined structure is rotated 90° from the incident polarisation. The protruding interior surface of the waveguide which narrows the waveguide creates a pocket or cavity behind the waveguide into which components from a circuit board can be inserted, for example voltage regulators. In addition, the protruding surface is generally planar such that the waveguide can be more easily cast than a waveguide having a thin plate; and can therefore be manufactured with a greater variety of materials.

According to a first aspect of the present invention, there is provided a waveguide rotator for use with a dual polarisation waveguide probe system for receiving at least two signals which are orthogonally polarised, the system having a waveguide into which at least two orthogonally polarised signals are received for transmission therealong, the waveguide having:

a first probe extending from a wall of the waveguide into the interior of the waveguide, the first probe being adapted to receive a first polarised signal traveling in the same longitudinal plane thereof, signal isolation means extending from the wall of the waveguide and the isolating means being located downstream of the first probe lying in the longitudinal plane for reflecting the first polarised signal in the longitudinal plane back to the probe means and allowing a second polarised signal, orthogonal to the first polarized signal to pass along the waveguide, second probe means located downstream of the signal isolating means and extending from the wall of the waveguide in the longitudinal plane, signal rotator means disposed in the waveguide downstream of the second probe means and having a protruding surface extending from an interior surface of the waveguide partly across the waveguide towards a short circuit disposed at an end of the waveguide, the signal rotator means being dimensioned and proportioned such that an incident polarisation component of the second polarisation signal propagates to the short circuit at the end of the waveguide and is reflected therefrom and a second incident polarisation component is cut-off by the protruding surface and before reaching the short circuit and is reflected substantially by the protruding surface at a frequency dependent cut-off point whereby the reflected first and second components recombine within the waveguide such that the polarisation of the reflected signal is rotated by 90° from the incident polarisation such that the reflected polarised signal is in the longitudinal plane for detection by the second probe means.

In a preferred arrangement a suitably sized wedge-shaped protrusion is located into the short circuit end of the waveguide for rotating a polarised signal 90°, that is vertical to horizontal polarity or vice-versa. This rotation is achieved by introducing a phase shift between the two components of the incident signal.

A forward traveling (incident) horizontally polarised signal is separable into two components, E1 and E2. The wavelength of E1 and E2 is determined by the width of the waveguide perpendicular to the component. As the signal propagates along the wedge part of the waveguide, the wavelength of the E2 component remains unaffected because the width of the guide perpendicular to E2 remains constant. Conversely, the wavelength of the E1 component increases as it propagates along the wedge due to the decreasing waveguide width. The result of this is to change the phase of E2 relative to E1, that is E2 leads E1 in phase, and this effect is doubled when the signal is reflected back along the waveguide. When the wedge is correctly proportioned and dimensioned E2 leads E1 by 180° when the signal starts to propagate back along the waveguide beyond the wedge-shaped protrusion. Recombining the E1 and E2 components results in converting the horizontally polarised signal EV to vertical polarisation EH. The wedge-rotator can be optimised to provide a reasonably flat 180° phase shift over the required operating frequency range providing 90° rotation of the incident linearly polarised signal.

Preferably, the waveguide cross-section is substantially square. Alternatively, the waveguide cross-section may be rectangular or circular or any other suitable waveguide cross-section.

Preferably also, the wedge-shaped protrusion extends substantially across the width of the waveguide and narrows to a common location on the waveguide wall to provide a substantially planar surface between the waveguide wall and the rear waveguide reflecting wall.

Alternatively, the waveguide wedge-shaped protrusion may have cut-outs so that it does not extend completely across the width of the waveguide at the rear reflecting wall.

Alternatively, the wedge may be stepped, the wedge being formed by a series of triangular protrusions of increasing waveguide width. It will be appreciated that increasing the number of protrusions or steps approximates the stepped wedge rotator to a smooth surface wedge rotator.

In a further alternative arrangement dual wedge-shaped protrusions may be used on opposed sides of the waveguide. In yet a further embodiment of the invention, one or both dual wedges may be stepped.

In accordance with another aspect of the present invention, there is provided a method of rotating a polarised signal traveling in a waveguide having a short circuit at one end by substantially 90°, the method comprising the steps of, providing a protrusion in a waveguide, the protrusion extending partially across the waveguide cavity, allowing a first component of the polarised signal to travel to the short circuit at the end of the waveguide and be reflected from the end back along the waveguide, increasing the wavelength of a second component of the polarised signal by decreasing the width of the waveguide by the protrusion, reflecting the second component from the protrusion at a frequency dependent cut-off point before the second component reaches the short circuit, recombining the reflected first and second components in the waveguide whereby the recombined polarised signal is rotated substantially 90° from the polarisation of the incident signal.

In accordance with a further aspect of the invention, there is provided a low-noise block (LNB) for use with a satellite dish receiving-signals broadcast by a satellite which includes two signals orthogonally polarised in the same frequency band, the LNB comprising:

a feedhorn, a waveguide coupled to the feedhorn, the waveguide having a printed circuit board support surface and a short circuit end plate, a printed circuit board mounted on the support surface and having first and second probes extending into the waveguide, the probes being disposed in the same longitudinal plane, a second rotator structure disposed within sad the waveguide between the second probe and the short circuit end plate, the signal rotator structure narrowing the waveguide to a component of a polarised signal to increase the wavelength of the component and reflect the component at a frequency dependent cut-off point before it reaches the short circuit, and permitting an orthogonal component of the polarised signal to be reflected by the short circuit, the reflected components being recombined within the waveguide before reaching the second probe whereby the recombined polarised signal rotates 90° from the polarisation of the incident signal into the same longitudinal plane as the probes.

These and other aspects of the present invention will become apparent from the following description when taken in combination with the accompanying drawings, wherein like reference numerals refer to like and corresponding parts of the various drawings, in which:

DETAILED DESCRIPTION OF THE PREFERRED EMBODIMENTS

Figure 1:
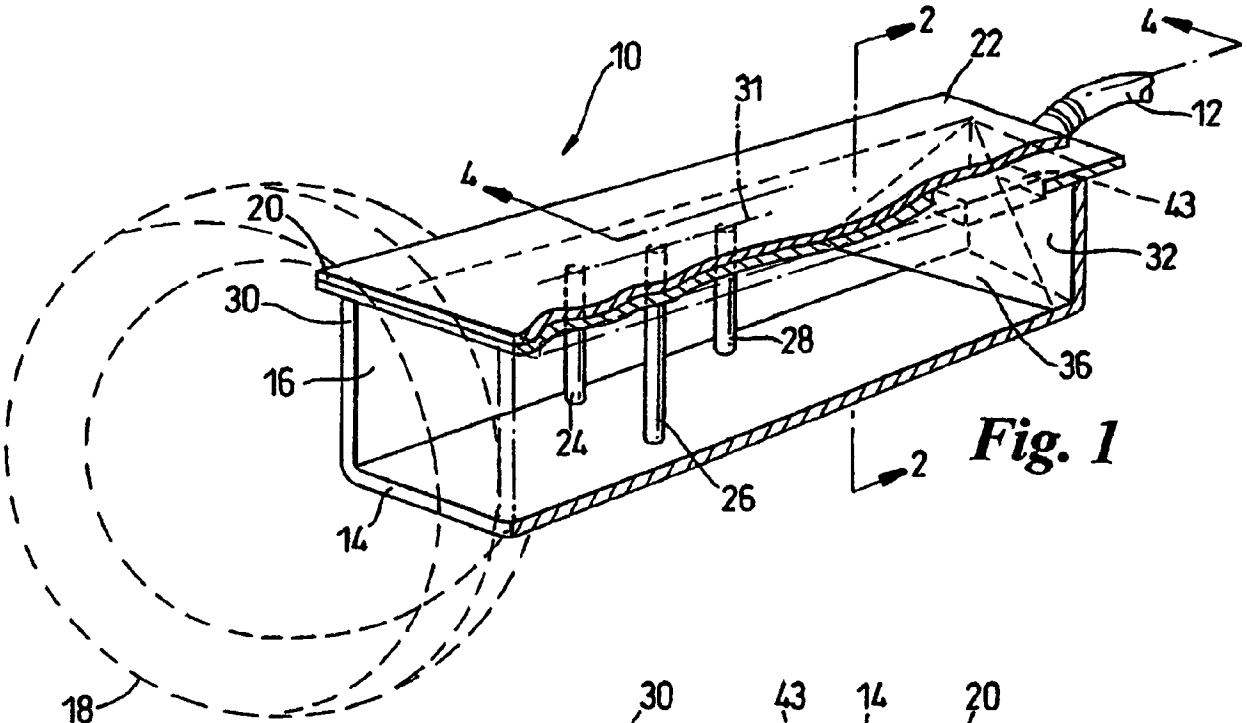
FIG. 1 is a partly broken-away view of a low-noise block receiver with a generally square waveguide including a wedge rotator in accordance with a preferred embodiment of the present invention.
Figure 4:
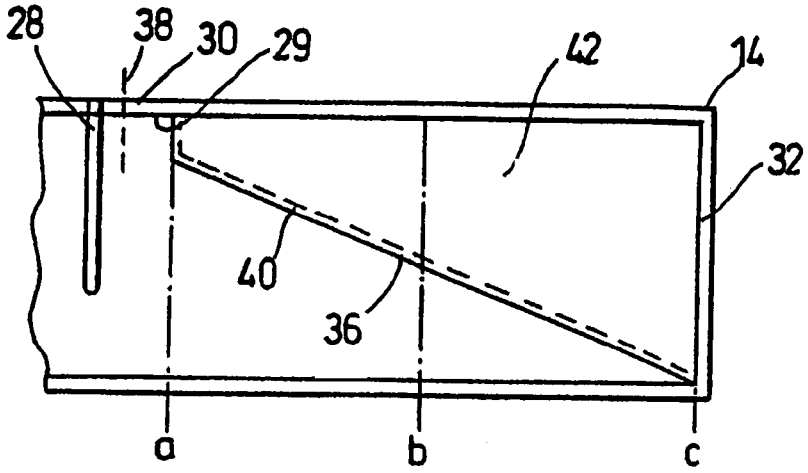
FIG. 4 depicts a side view through the waveguide showing the profile of the wedge rotator taken on the line 4—4.

Reference is made to FIG. 1 of the drawings which depicts a low-noise block receiver, generally indicated by reference numeral 10, which is adapted to be mounted to a satellite receiving dish via a boom arm (not shown in the interests of clarity) in a way which is well known in the art. As is also well known, the low-noise block receiver 10 is arranged to receive high frequency vertically and horizontally orthogonally polarised radiation signals from the satellite dish and to process these signals to provide an output which is fed to a cable 12 which is, in turn, connected to a satellite receiver decoder unit (not shown) for subsequent processing. The low-noise block receiver 10 includes a cast metal waveguide 14 which is shown partly broken away to depict the interior shape of the waveguide and interior waveguide components. The waveguide is generally square in cross-section. The waveguide has a front aperture 16 for facing a satellite dish for receiving electromagnetic radiation from an integral circular corrugated feedhorn 18 (shown in broken outline) which is located at the front of the waveguide 14. Integrally cast with the waveguide 14 and feedhorn 18 is a top surface plate 20 for receiving a printed circuit board 22 containing electronic components for receiving signals from the waveguide 14 and for processing these signals prior to transferring the signals to cable 12. The waveguide and internal components are similar to those disclosed in applicant's co-pending International Patent Applications WO 92/22938 and WO 98/10479. Accordingly, disposed in the waveguide in the same longitudinal plane is a first probe 24, a reflective post 26 and a second probe 28. In this embodiment, the reflective post 26 extends across the entire width of the interior of the waveguide. The outputs of the probes 24 and 28 pass through the waveguide wall 30 in the same longitudinal plane, generally indicated by reference numeral 31. The probes extend through cast plate 20 to the integrated circuit board 22. The distance between probes 24, 28 and the reflective post 26 is nominally $\lambda/4$ where $\lambda$ is the wavelength of the signals in the waveguide. At the downstream end of the waveguide 14 which is furthest from the aperture 16, there is disposed a short circuit end plate 32 which, as best seen in FIG. 4 of the drawings, is disposed perpendicular to the longitudinal axis of the waveguide 14. The end plate 32 acts as a short circuit reflecting plate, as is described in detail in WO 92/22938 and WO 98/10479, for signals traveling along the waveguide.

Figure 2:
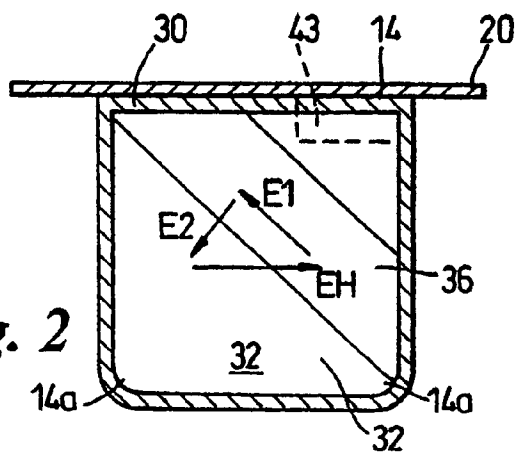
FIG. 2 is a sectional view taken on the line 2—2 of FIG. 1 depicting the horizontally polarised signal and components E1 and E2.
Figure 3:
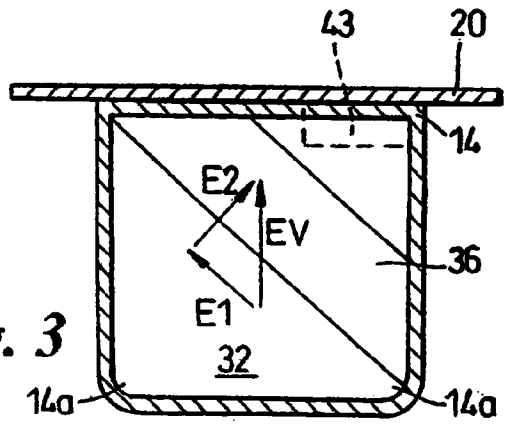
FIG. 3 is a similar view to FIG. 2 but depicting the vertically polarised signal formed by components E1 and E2 after reflection from the rear of the waveguide and the wedge rotator.

Reference is now made to FIGS. 2 and 3 of the drawings which are sectional views through the waveguide 14 towards the short circuit 32. It will be seen from FIGS. 2 and 3 that the waveguide is not exactly square. The lower corners of the waveguide 14*a* are in fact rounded or beveled to provide a suitable exterior shape for the waveguide 14. Also shown in the waveguide 14 is a wedge-shaped protrusion, generally indicated by reference numeral 36, which extends from the interior wall 29 of the waveguide to the short circuit end 32 at which it extends diagonally across the end of the waveguide.

The wedge-shaped protrusion rotates a polarised signal 90° on reflection, i.e. vertical to horizontal polarity or vice-versa, by introducing a phase shift between the horizontal and vertical orthogonal components of the incident signal as will be described. This is best seen from FIGS. 2 and 3 of the drawings. Firstly, with reference to FIG. 2, an incident, forward traveling (into the paper) horizontally polarised signal EH, can be separated into two components E1 and E2. The wavelength of E1 and E2 is determined by the width of the waveguide perpendicular to the component. As the signal propagates along the wedge 36, the wavelength of the E2 component remains unaffected because the width of the waveguide 14 perpendicular to component E2 remains constant. In contrast, the wavelength of the E1 component increases as it propagates along the wedge 36 due to the decreasing width of the waveguide as the waveguide narrows due to the increasing wedge, as best seen in FIG. 4 of the drawings. The effect of this is to change the phase of the E2 component relative to E1; that is, E2 leads E1 in phase. This effect is doubled as the signal is reflected back along the waveguide (out of the paper). If the wedge 36 is correctly dimensioned and proportioned E2 will lead E1 by 180° by the time the signal is propagating back along the waveguide at position 38, as shown in FIG. 4. Recombining components E1 and E2 results in converting the horizontal polarisation signal EH to a vertical polarisation signal EV, as best seen in FIGS. 2 and 3 of the drawings. Thus, the signal which has traveled past the probe 28 has been rotated by 90° such that it can be detected by probe 28 in the same way as the probe detected reflected signals in applicant's co-pending applications WO 92/22938 and WO 98/10479.

Figure 5A:
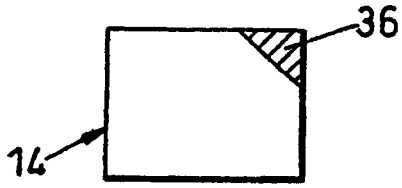
FIGS. 5*a*, 5*b* and 5*c* depict cross-sectional views through the wedge rotator taken on the lines a, b and c of FIG. 4 and showing the increasing effective cross-section of the wedge rotator within the waveguide housing.
Figure 5B:
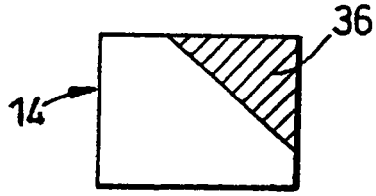
Figure 5C:
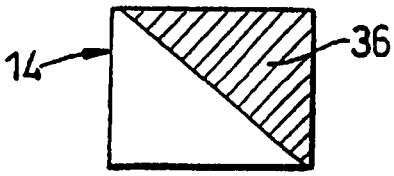

Reference is also made to FIGS. 4 and 5*a*–5*c* of the drawings where the side view of FIG. 4 depicts the profile of the wedge 36 within the waveguide and shows that the wall 40 of the wedge increasingly projects into the waveguide 14 as it approaches the short circuit end 32. The cross-sectional views in FIGS. 5*a*, 5*b* and 5*c* show the increasing at locations a, b and c cross-section of the waveguide in FIG. 4 taken up by the wedge rotator towards the short circuit end. The wall 38 of the wedge rotator defines a cavity 42 (see FIG. 4) behind the wall into which a pocket 43 for electronic components of the printed circuit board 22 (shown in FIG. 1) may be disposed to facilitate manufacture and overall compactness of the LNB.

Figure 6:
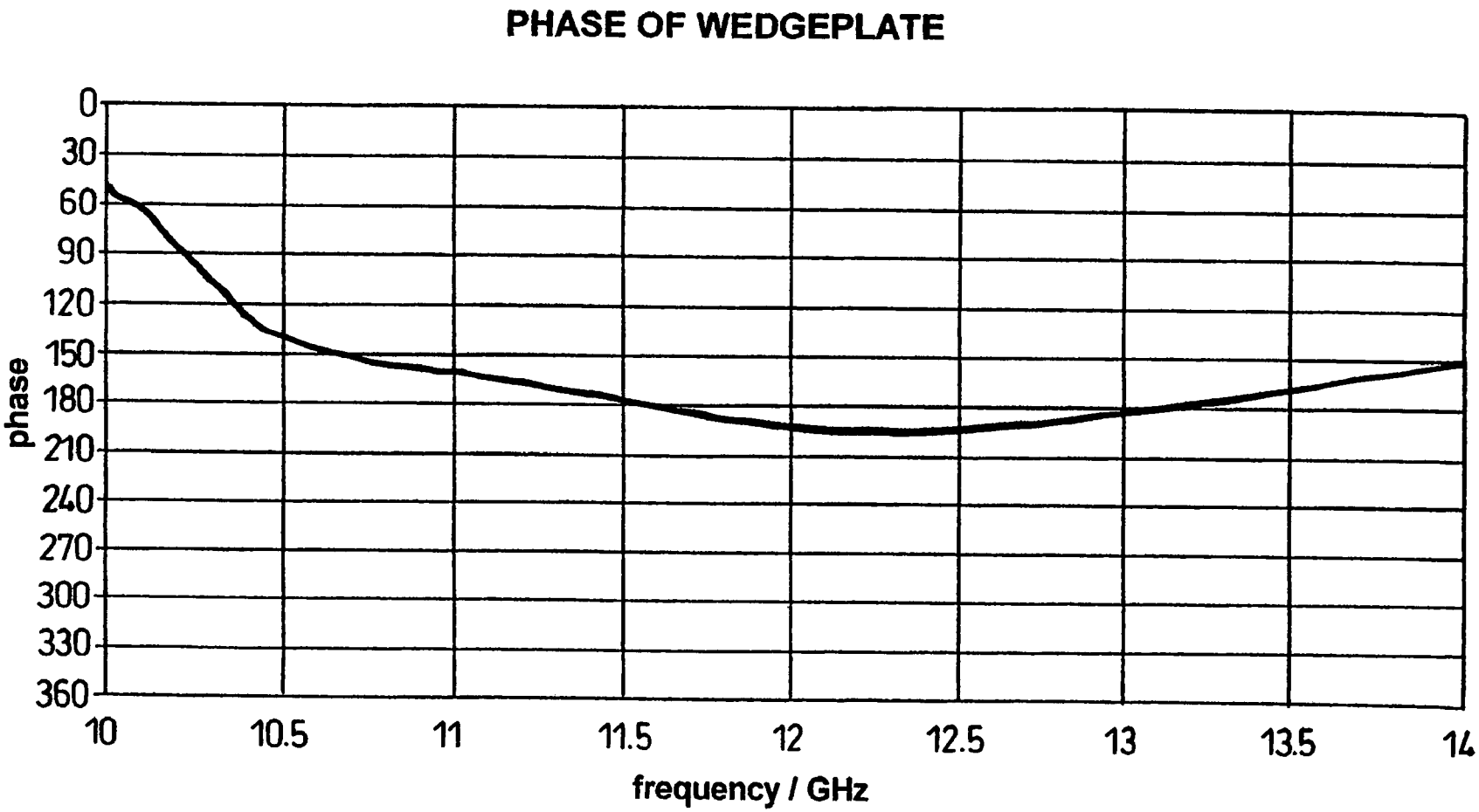
FIG. 6 is a graph of phase vs. frequency for the wedge plate rotator shown in FIGS. 1–4 and 5*a*–5*c;*
Figure 7:
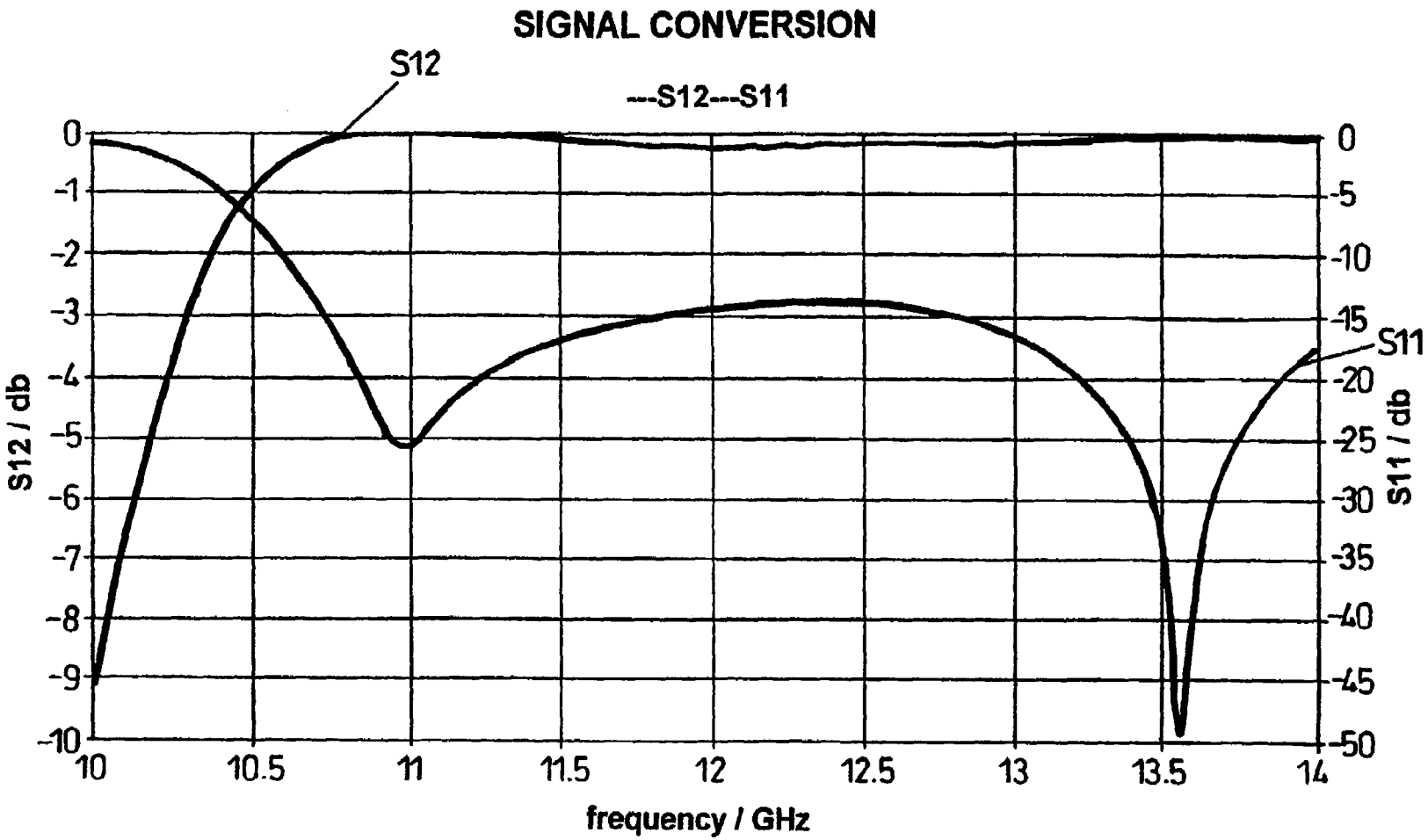
FIG. 7 is a graph of single conversion (insertion loss/return loss) vs. frequency for the wedge rotator waveguide structure shown in FIGS. 1–4 and 5*a*–5*c;*

Reference is now made to FIGS. 6 and 7 of the drawings. FIG. 6 depicts a graph of phase vs. frequency and shows that the phase shift created by the polarisation wedge rotator is substantially 180° across the frequency range of interest for such low-noise blocks which is 10.7 to 12.75 GHz for the Astra satellite. FIG. 7 shows the insertion loss (S12)/return loss (S11) in decibels (dB) over the frequency range which shows that there is minimal insertion loss (S12)/return loss (S11) over the desired frequency range.

Figure 8:
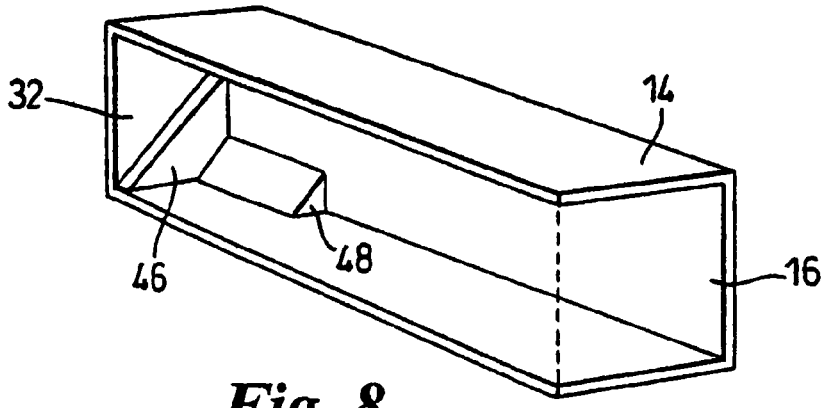
FIG. 8 depicts a diagrammatic view of an alternative embodiment of the invention in which the wedge rotator is stepped being formed of triangular sections which extend across the waveguide by different amounts.
Figure 9:
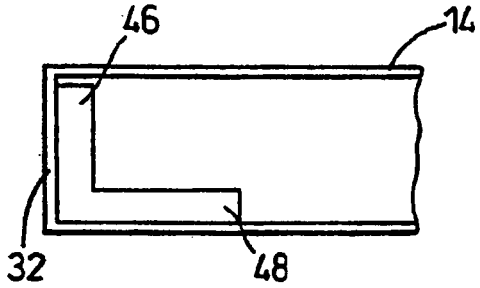
FIG. 9 depicts a side view of FIG. 8 taken through the waveguide.

Reference is now made to FIG. 8 of the drawings which depicts a diagrammatic view of an alternative embodiment of the invention in which like numerals refer to like parts and in which the wedge rotator is formed of triangular sections 46,48 which extend across the waveguide by different amounts. In this embodiment two triangular sections are shown to provide a stepped wedge rotator. A side view of the stepped wedge rotator is shown in FIG. 9. The larger triangular section wedge, generally indicated by reference numeral 46, fills a larger proportion of the waveguide such that only a component perpendicular to the wedge portion 46 can propagate. The phase shift increases with increasing frequency as can be best seen from FIG. 10 of the drawings. The conversion of an incident signal horizontally polarised into a reflected vertically polarised signal is shown in FIG. 11 (S12) and the return loss is also shown (S11). Although this wedge alone can be optimised in the band centre at 11.75 GHz, it has relatively poor performance, on its own, at the band edges.

The smaller wedge 48 fills only a relatively small proportion of the waveguide 14 thus allowing components parallel to, and perpendicular to, the wedge portion 48 to propagate along the waveguide. It will be seen from FIG. 10 that the resultant phase shift between the components reduces with increasing frequency. The conversion of an incident horizontally polarised signal into a reflective vertically polarised signal is shown in FIG. 11 (S12) and the return loss is also shown (S11). The device can be optimised in the band centre at 11.75 GHz but, once again, poor performance is achieved at the band edges.

Figure 10:
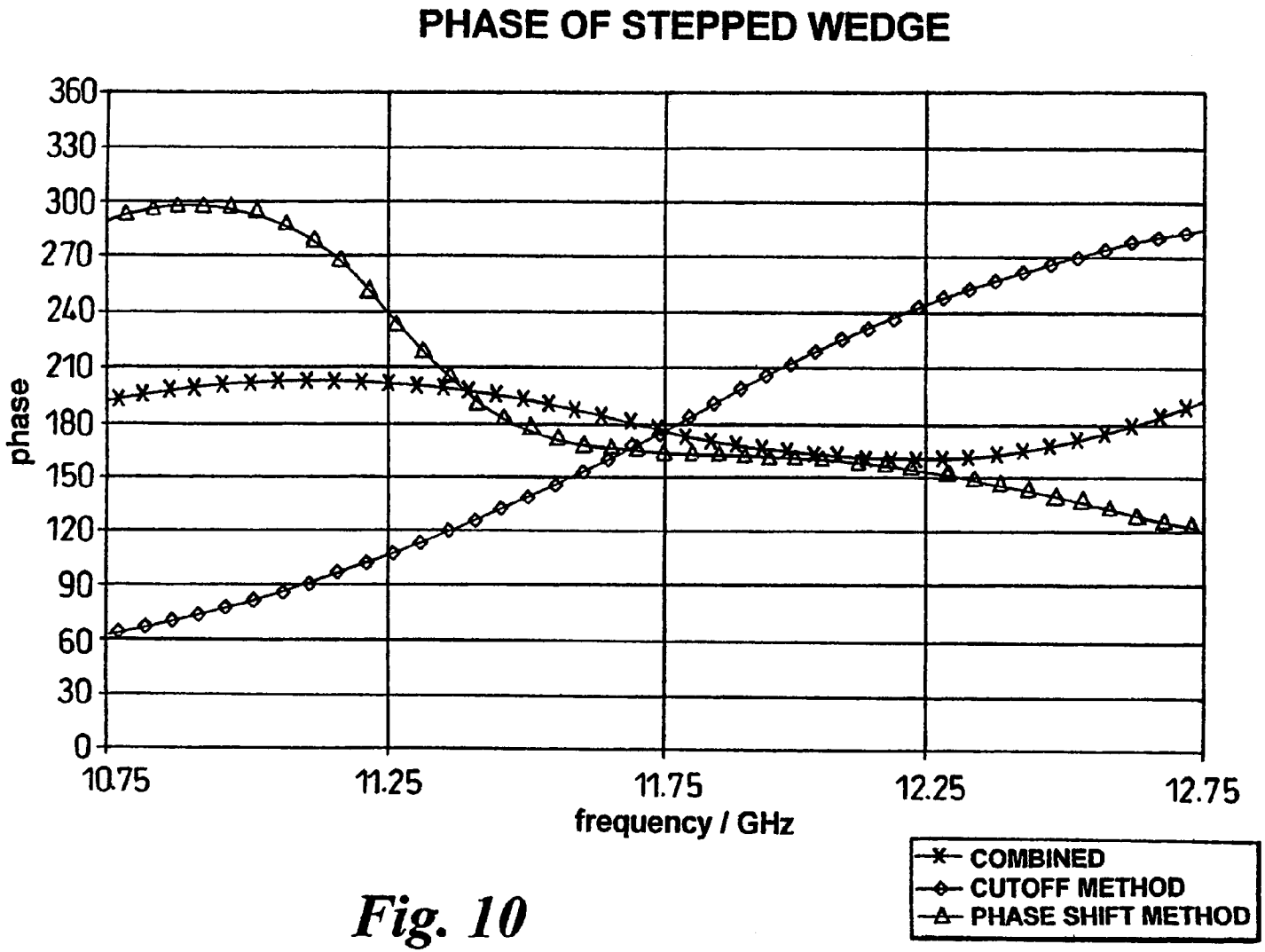
FIG. 10 depicts a graph of phase vs. frequency for the stepped wedge rotator waveguide and shows, for comparative purposes, the response from the cut-off method and the phase shift method.
Figure 11:
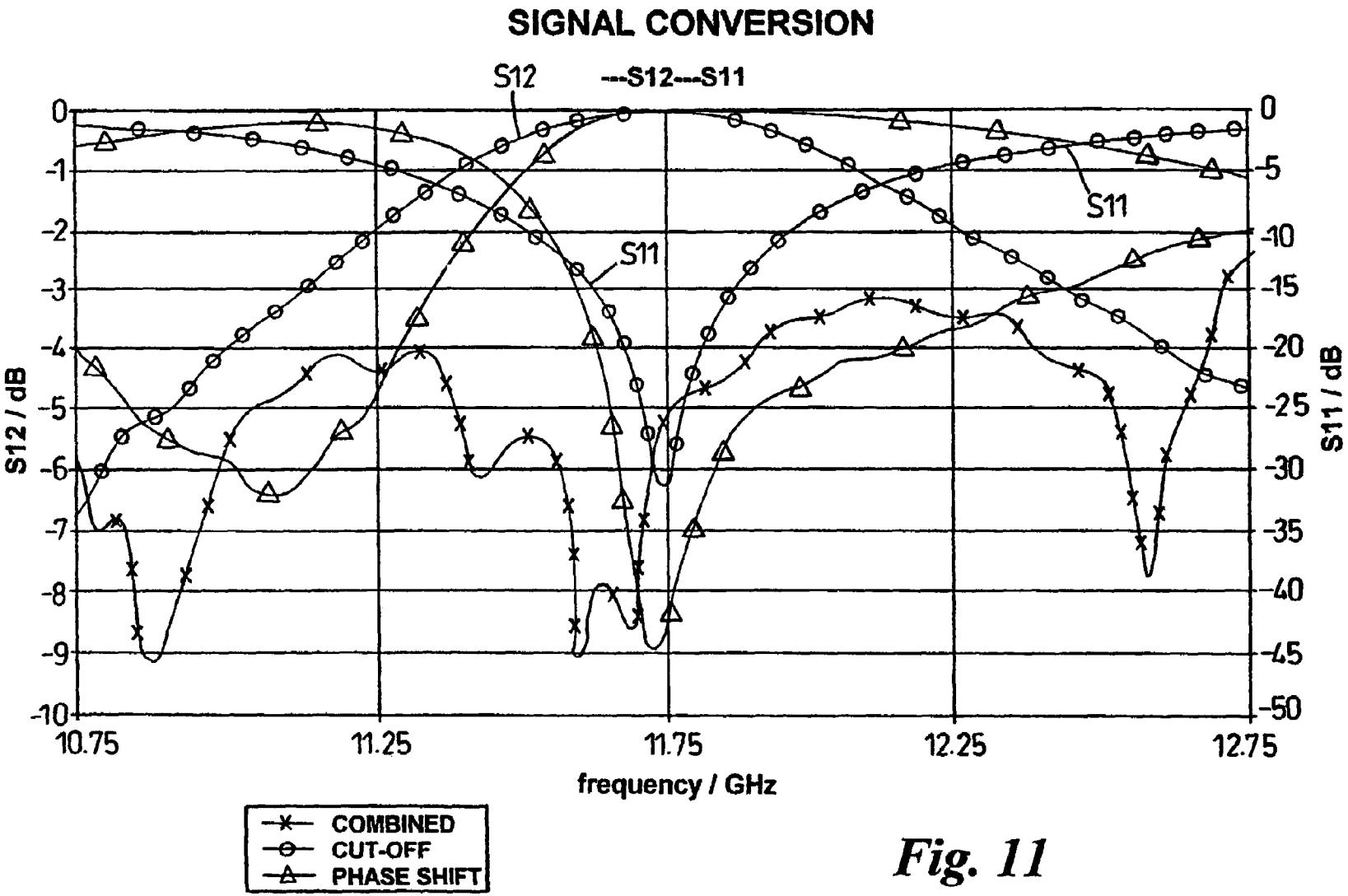
FIG. 11 depicts a graph of signal conversion (insertion loss/return loss) vs. frequency for the stepped wedge rotator with the corresponding responses for the cut-off method, and for phase shift method being shown separately for comparative purposes.

When the waveguide, as shown in FIG. 8, has combined cross-sections 46 and 48 to create a stepped wedge, a substantially flat phase vs. frequency characteristic is achieved as shown in FIG. 10 of the drawings. The signal conversion and insertion/return loss for this arrangement is also shown in FIG. 11 and it will be seen that the bandwidth is greatly enhanced over the desired Astra satellite frequency range.

Figure 13A:
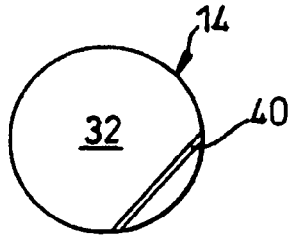
FIGS. 13*a*, 13*b* and 13*c* are respective cross-sectional views taken on lines A, B and C through the waveguide and wedge rotator shown in FIG. 12.
Figure 12:
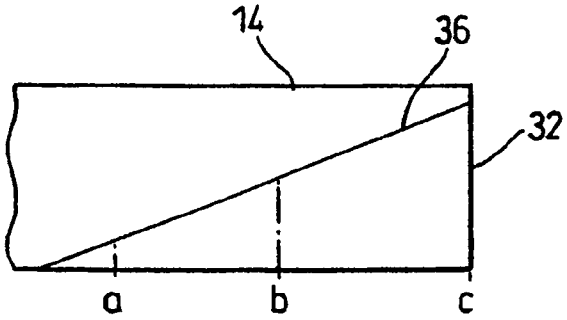
FIG. 12 depicts a partly perspective view of a circular waveguide with a wedge rotator disposed therein.
Figure 13B:
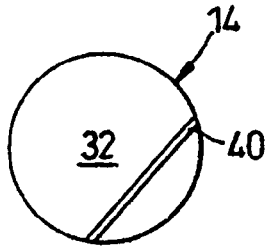
Figure 13C:
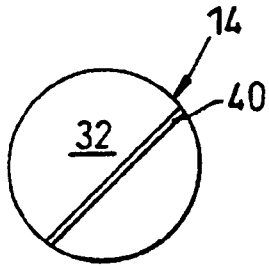

It will be appreciated that various modifications may be made to the embodiments hereinbefore described, without departing from the scope of the invention. For example, the waveguide may be circular in cross-section with a conical section used similar to that shown in FIGS. 1–4 and 5*a*–5*c* of the drawings. FIG. 12 shows a longitudinal section through a circular waveguide and FIGS. 13*a*, 13*b* and 13*c* show respective cross-sections at locations a, b and c of FIG. 12 showing the increasing protrusion of the wedge into the waveguide as the wedge extends towards the end face 32 of the waveguide 14.

Figure 14:
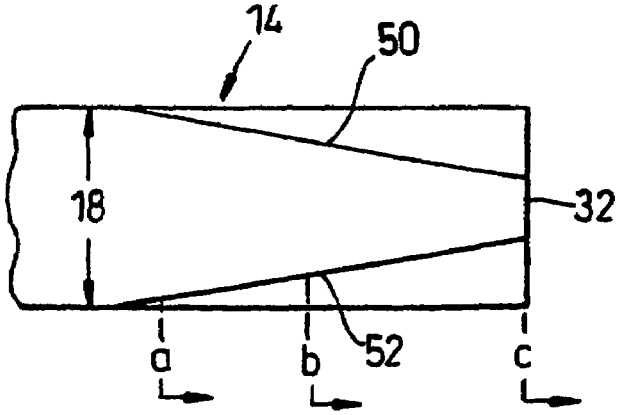
FIG. 14 depicts a further alternative embodiment of the present invention in which a square waveguide has dual wedge rotators inserted therein.
Figure 15A:
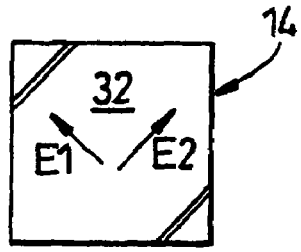
FIGS. 15*a*, 15*b* and 15*c* are respective cross-sectional views taken on the lines a, b and c in FIG. 14 showing the increasing cross-section of the wedges as the rotators approach the end plate.
Figure 15B:
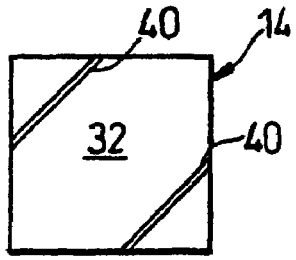
Figure 15C:
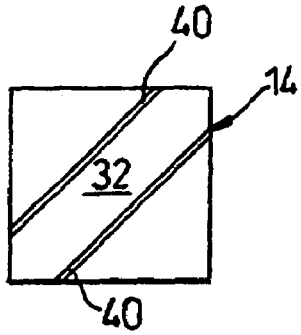

FIG. 14 depicts a side view of a further embodiment of a wedge rotation system in which the waveguide 14 has two wedge-shaped protrusions 50 and 52 extending from the waveguide wall 18 towards the end face 32 instead of a single wedge. Sectional views taken at locations a, b and c of FIG. 14 are depicted in FIGS. 15*a*, 15*b* and 15*c* respectively and show the increasing protrusion of the wedges as they extend towards the end face 32 of the waveguide. This arrangement will operate in the same way the previously described embodiments.

Figure 16:
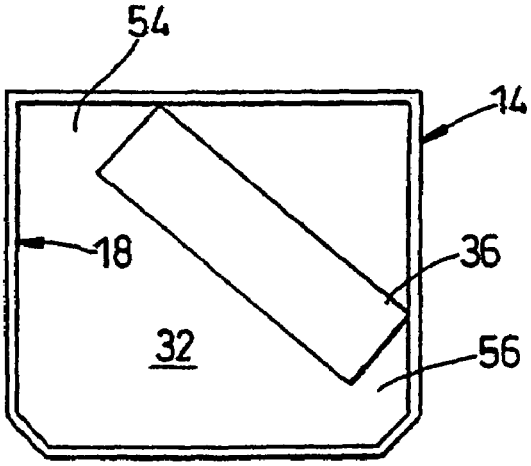
FIG. 16 shows a further embodiment of the present invention in which a wedge rotator is provided in a substantially square waveguide where the wedge does not extend the entire width of the waveguide at the reflecting end due to wedge cut-outs.
Figure 17:
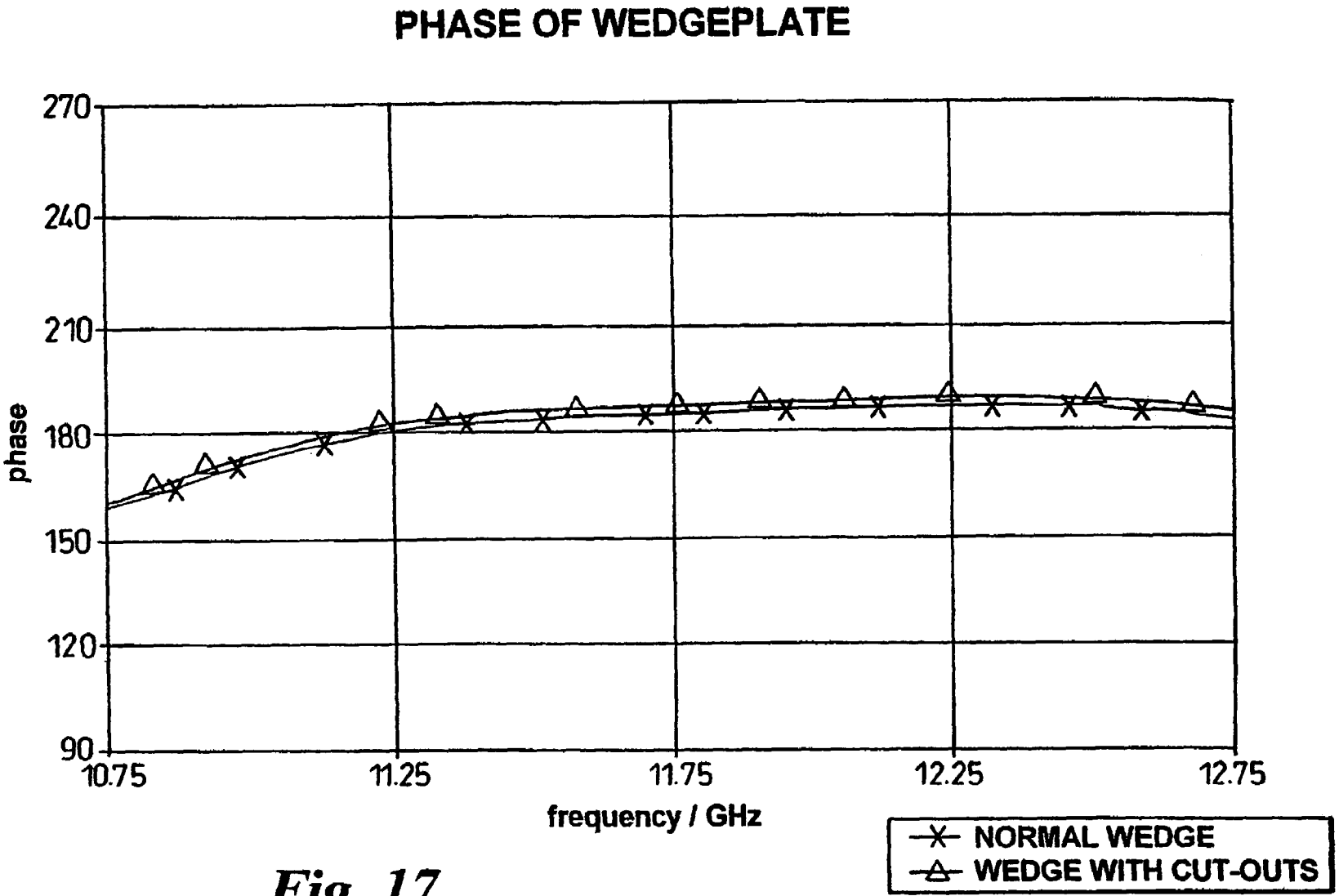
FIG. 17 shows a graph of phase vs. frequency for the wedge with cut-outs and for the wedge shown in FIG. 1 response also depicted for comparative purposes.
Figure 18:
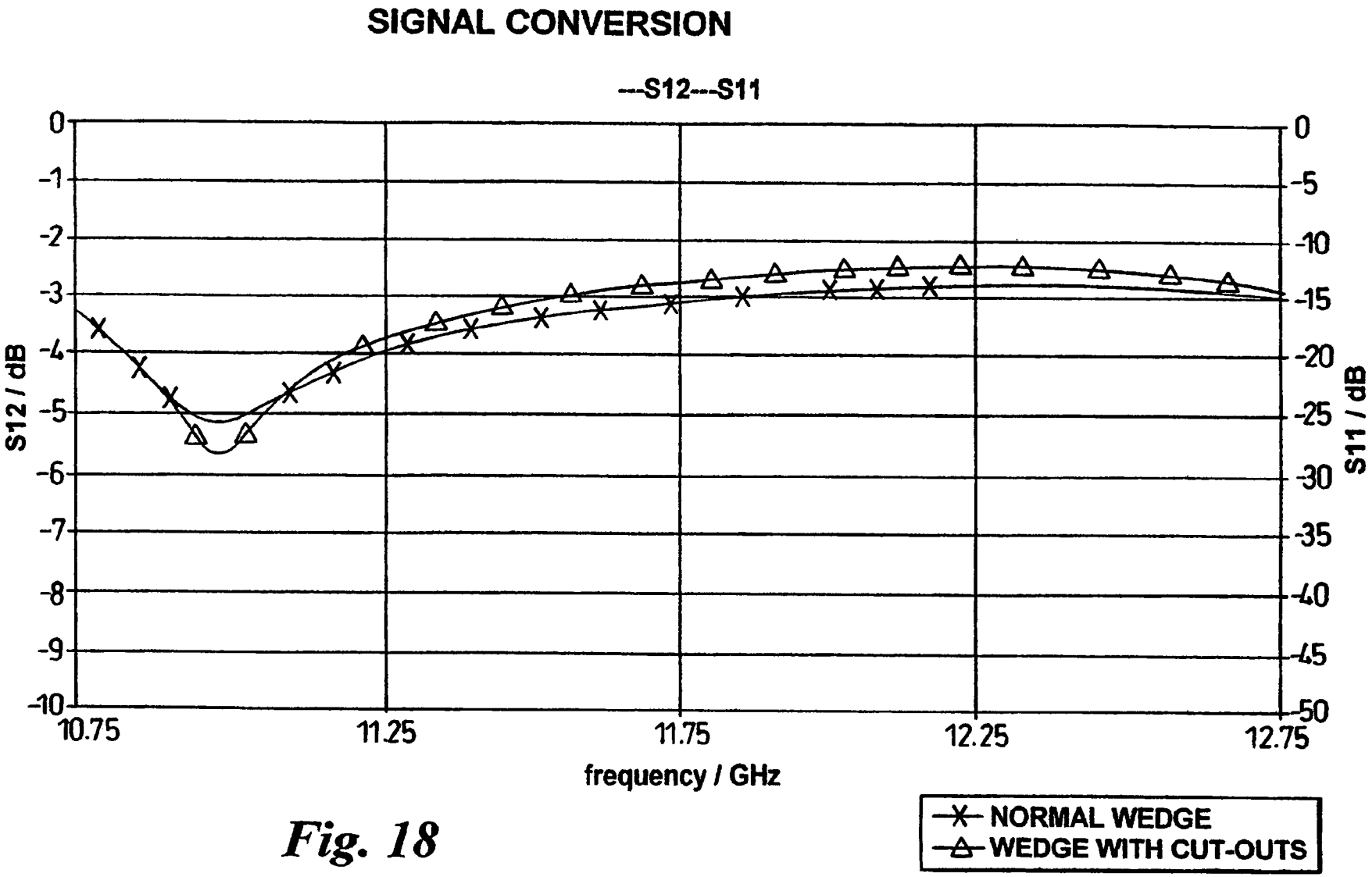
FIG. 18 is a graph of single conversion (insertion loss/return loss) vs. frequency for the wedge rotator with cut-outs with normal wedge response also shown for comparative purposes.

A yet further embodiment is shown in FIG. 16 of the drawings where it can be seen that the wedge does not have to extend across the entire width of the waveguide at the end face. In this arrangement it will be seen that the wedge rotator 36 has cut-outs to define non-enclosed areas 54,56 at the sides of the wedge. This arrangement does not materially affect the performance of the waveguide, as can be seen with reference to FIGS. 17 and 18. In this case, FIG. 17 shows a graph of phase vs. frequency for both the normal wedge of FIGS. 1–4 and 5*a*–5*c* and the wedge with cut-outs and it will be seen that the performance is substantially identical over the frequency range of interest, i.e. 10.7 to 12.75 GHz, thereby providing a substantially flat phase shift of 180°. Similarly, the single conversion for the wedge with cut-outs is substantially identical to the normal wedge for both S12 and S11 over the frequency range of interest.

Figure 19:
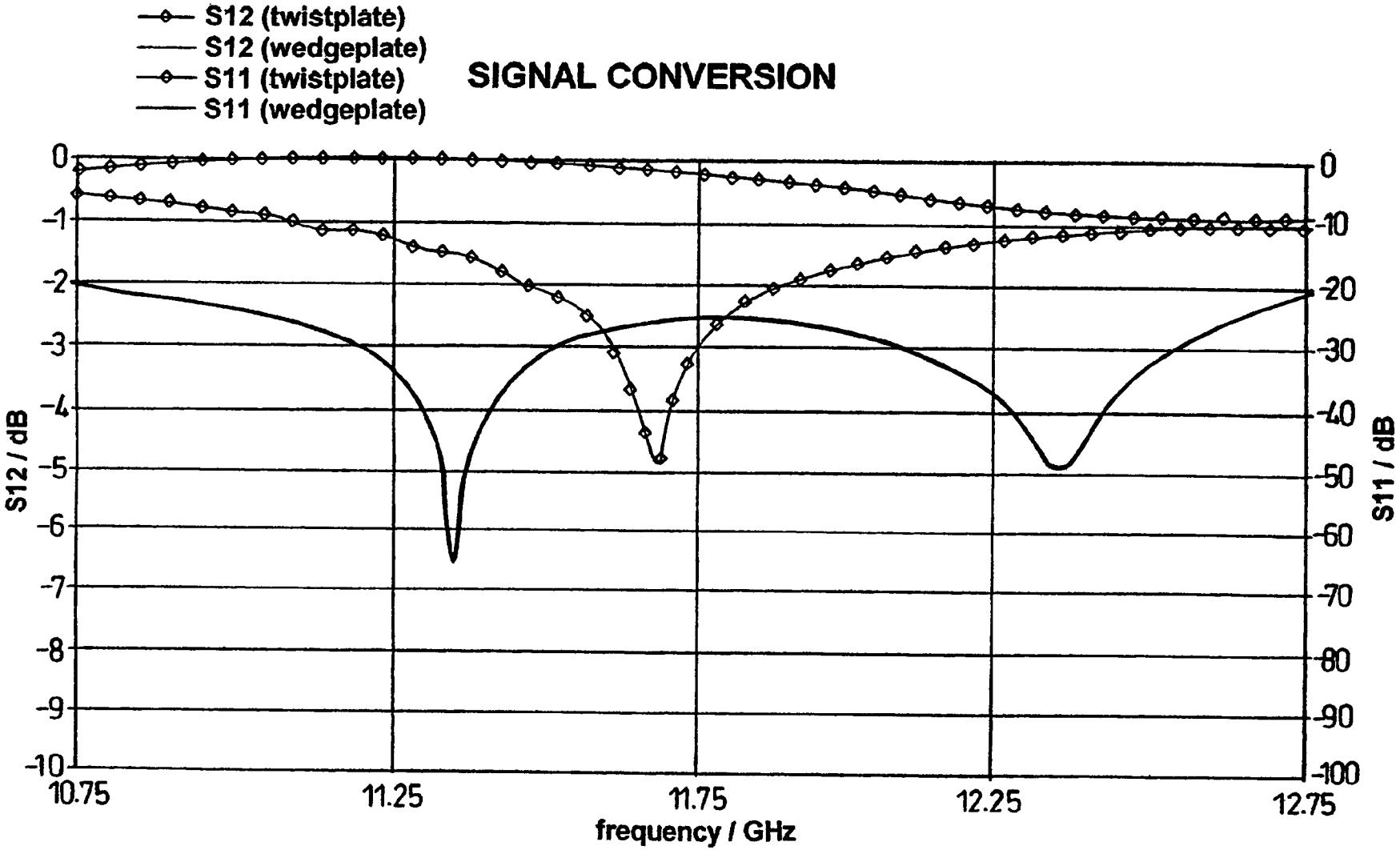
FIG. 19 is a graph of signal conversion (insertion loss/return loss) vs. frequency comparing the response of a wedge rotator in a square waveguide with a 45° twist plate, as in the prior art, in a square waveguide.

Reference is now made to FIG. 19 of the drawings which shows the insertion loss (S12) and the return loss (S11), in decibels, for a wedge rotator (wedge plate) of the type shown in FIG. 1 and a twist plate in a square waveguide. The twist plate is oriented at 45° to the incident polarisation and operates like those disclosed in WO 92/22938 and WO 98/10479. It will be seen that the performance of the wedge plate is superior over the frequency range of interest, 10.7 to 12.75 GHz. For all embodiments it will be understood that the cut-off point is frequency dependent, with higher frequency signals being reflected at a cut-off point nearer to the short circuit, i.e. the higher the frequency to the signal, the closer to the short circuit is the cut-off point.

It will also be appreciated that further modifications may be made to the embodiments hereinbefore described without departing from the scope of the invention. For example, it will be appreciated that the waveguide may be made of any suitable shape and that the wedge insertion may not be exactly the same shape as that shown. The wedge insertion may be of any suitable shape as long as the wedge protrudes into the waveguide to provide a cut-off at a certain point along its length and signal reflection for recombination, with the signal reflected from the end of the waveguide, to give a suitable phase shift along the waveguide at a desired location. It will also be appreciated that this wedge rotator may have application to waveguides other than those for use with low-noise blocks. The principle of a wedge rotator in a waveguide is applicable to many shapes of waveguide and many applications. Furthermore, the waveguide/LNB may be cast or injection moulded in plastic with internal surfaces metallised by vapour or electroplated to create low-loss surfaces.

Advantages of the invention are that manufacturing of such waveguide rotators is facilitated because thin reflector plates do not require to be cast. This allows the use of additional casting materials to facilitate flexibility in choice of materials. The provision of a wedge rotator allows a pocket or cavity to be created in the waveguide into which electronic components on a printed circuit board 22 can be inserted so that the overall dimensions of a waveguide and adjacent integrated circuit may be minimised. The wedge rotator provides improved performance over the desired frequency range in similar waveguides with a twist plate. In the application to a low-noise block (LNB) this facilitates the insertion of a voltage regulator into the cavity to minimise the onboard integrated circuit area and allow the entire assembly to be encompassed in a housing of minimal volume. This minimises manufacturing costs and storage and transport costs when very large numbers of such low-noise blocks and waveguides have to be made.

The invention claimed is:

1. A low-noise block (LNB) for use with a satellite dish receiving signals broadcast by a satellite which includes two incident signals orthogonally polarised in the same frequency band, said LNB comprising:

a feedhorn, a waveguide coupled to said feedhorn, said waveguide having a printed circuit board support surface and a short circuit end plate, a printed circuit board mounted on said support surface and having first and second probes extending into said waveguide, said probes being disposed along a common longitudinal plane, a signal rotator structure disposed within said waveguide between said second probe and said short circuit end plate, said signal rotator structure comprising a wedge-shaped protruding surface extending from an interior surface of said waveguide partly across said waveguide, said signal rotator structure narrowing the waveguide with respect to a first component of one of the two polarised incident signals to increase the wavelength of the first component and reflect the first component at a frequency dependent cut-off point before said first component reaches the short circuit end plate, and permitting an orthogonal second component of said one of said two incident polarised signal to be reflected by said short circuit end plate, the reflected first and second components being recombined within said waveguide to provide a recombined polarised signal before reaching said second probe whereby the recombined polarised signal rotates 90° from the polarisation of the other of the two incident signals into the longitudinal plane common with said probes.

2. A waveguide rotator for use with a dual polarisation waveguide probe system for receiving at least first and second orthogonally polarised incident signals, said system having a waveguide into which the at least two orthogonally polarised signals are received for transmission therealong, said waveguide having:

a first probe extending from a wall of the waveguide into the interior of the waveguide, said first probe being adapted to receive said first orthogonally polarised signal traveling along a common longitudinal plane thereof, a signal isolator extending from the wall of the waveguide, said signal isolator being located downstream of said first probe and lying in said longitudinal plane for reflecting the first orthogonally polarised signal in said longitudinal plane back to said first probe and allowing said second orthogonally polarised signal, orthogonal to said first polarised signal to pass along said waveguide, a second probe located downstream of said signal isolator and extending from the wall of the waveguide in said longitudinal plane, a signal rotator disposed in said waveguide downstream of said second probe and having a wedge-shaped planar inclined protrusion extending from an interior surface of said waveguide partly across said waveguide towards a rear reflecting wall disposed at an end of said waveguide, said signal rotator being dimensioned and proportioned such that a first incident polarisation component of said second orthogonally polarised signal propagates to the rear reflecting wall at the end of the waveguide and is reflected therefrom and a second incident polarisation component of said second orthogonally polarised signal is cut-off by said protrusion before reaching the rear reflecting wall, and is reflected substantially by said protrusion at a frequency dependent cut-off point whereby said reflected first and second components recombine within said waveguide such that the polarisation of the recombined reflected signal is rotated by 90° from the polarisation of the second orthogonally polarised signal such that the recombined reflected polarised signal is polarised in said longitudinal plane for detection by said second probe.

3. A waveguide rotator as claimed in claim 2 wherein the waveguide cross-section is substantially square.

4. A waveguide rotator as claimed in claim 2 wherein the waveguide cross-section is rectangular or circular.

5. A waveguide rotator as claimed in claim 2 wherein the wedge-shaped protrusion extends substantially across the waveguide and narrows to a common location on the waveguide wall to provide a substantially planar surface between the waveguide wall and the rear reflecting wall of the waveguide.

6. A waveguide rotator as claimed in claim 2 wherein the wedge-shaped protrusion has cut-outs so that it does not extend completely across the width of the waveguide at the rear reflecting wall.

7. A waveguide rotator as claimed in claim 2 wherein the wedge-shaped protrusion is stepped, the wedge-shaped protrusion being comprised of a series of triangular protrusions of increasing waveguide width.

8. A waveguide rotator as claimed in claim 2 wherein the signal rotator is provided by dual wedge-shaped protrusions on opposed sides of the waveguide.

9. A waveguide rotator as claimed in claim 8 wherein one or both dual wedge-shaped protrusions may be stepped.

10. A method of rotating an incident polarised signal traveling in a waveguide having a short circuit at one end thereof by substantially 90°, said method comprising the steps of, providing a wedge-shaped inclined protrusion in the waveguide, said protrusion extending partially across said waveguide, allowing a first component of said incident polarised signal to travel to the short circuit at the end of said waveguide and be reflected from said end back along the waveguide, increasing the wavelength of a second component of said incident polarised signal by decreasing the cross-section of said waveguide by said protrusion, reflecting said second component from the protrusion at a frequency dependent cut-off point before said second component reaches said short circuit, recombining the reflected first and second components in said waveguide to form a recombined polarised signal rotated substantially 90° from the polarisation of the incident signal.

* * * * *